US005932010A

United States Patent [19]

Madrzak et al.

[11] Patent Number: 5,932,010

[45] Date of Patent: Aug. 3, 1999

[54] APPLICATION UNIT FOR DIRECTLY OR INDIRECTLY APPLYING A FLUID OR PASTY MEDIUM TO A CONTINUOUS MATERIAL WEB

[75] Inventors: Zygmunt Madrzak, Heidenheim; Manfred Ueberschaer, Nattheim, both of Germany

[73] Assignee: Voith Sulzer Papiermaschinen, Heidenheim, Germany

[21] Appl. No.: 08/855,642

[22] Filed: May 13, 1997

[30] Foreign Application Priority Data

May 20, 1996 [DE] Germany ..... 196 20 261

[51] Int. Cl.[6] ..... B05C 3/02

[52] U.S. Cl. ..... 118/413; 118/261

[58] Field of Search ..... 118/419, 413, 118/410, 261, 123, 126

[56] References Cited

U.S. PATENT DOCUMENTS

| | | | |
|---|---|---|---|
| 3,450,098 | 6/1969 | Williams | 118/126 |
| 3,783,781 | 1/1974 | Grommek | 101/157 |
| 4,245,582 | 1/1981 | Alheid et al. | 118/119 |
| 4,440,105 | 4/1984 | Jeltema | 118/410 |
| 4,732,776 | 3/1988 | Boissevain . | |
| 5,138,970 | 8/1992 | Sollinger | 118/126 |
| 5,556,467 | 9/1996 | Koskinen | 118/413 |

FOREIGN PATENT DOCUMENTS

| | | | |
|---|---|---|---|
| 0 512 971 | 8/1992 | European Pat. Off. . | |
| 3336704 | 4/1984 | Germany | 118/126 |
| 1 424 150 | 6/1974 | United Kingdom . | |
| WO 93/05887 | 4/1993 | WIPO . | |

*Primary Examiner*—Brenda A. Lamb
*Attorney, Agent, or Firm*—Taylor & Associates, P.C.

[57] ABSTRACT

An application unit for directly or indirectly applying a fluid or pasty medium to a continuous material web, particularly made of paper or cardboard, includes a support beam extending in its longitudinal direction substantially across the entire width of the material web; a counter-roll opposite the support beam; a doctor element detachably secured to the support beam via a holding device and extending substantially across the entire width of the counter-roll; and a pressing member disposed on the support beam and to which a pressing force is directly and/or indirectly applied by at least one pressing device and with which the doctor element can be pressed against the counter-roll at a predetermined pressure in the region of its blade-element end mated with the counter-roll. When viewed in cross section, the pressing member is formed as a parallelogram body supported at one end in or on at least one mount and running substantially parallel to the doctor element.

10 Claims, 6 Drawing Sheets

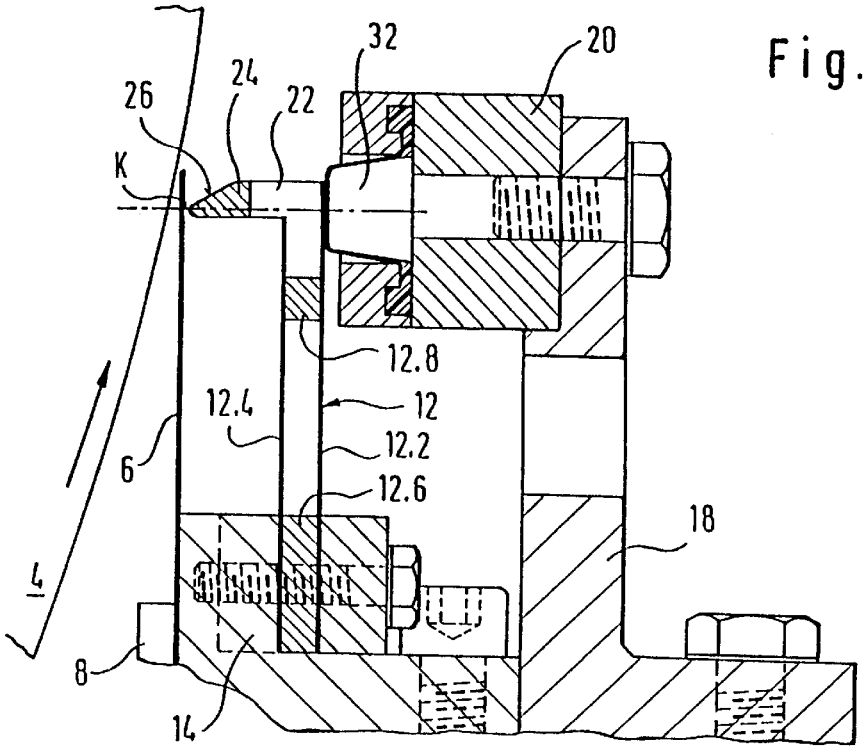
Fig.6
Fig.7
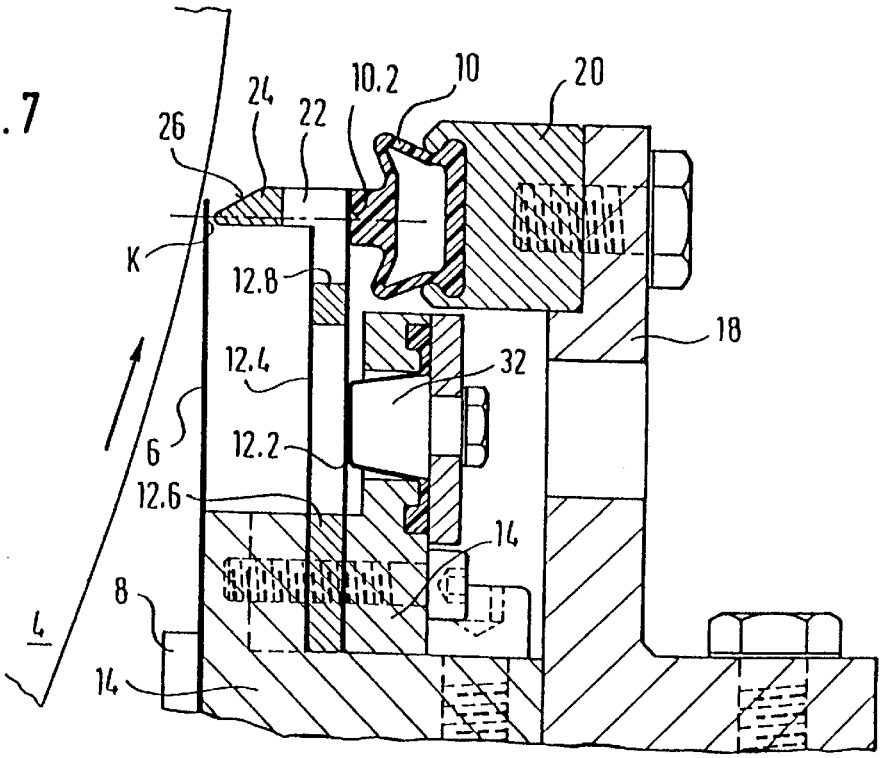

APPLICATION UNIT FOR DIRECTLY OR INDIRECTLY APPLYING A FLUID OR PASTY MEDIUM TO A CONTINUOUS MATERIAL WEB

BACKGROUND OF THE INVENTION

The present invention relates to an application unit for directly or indirectly applying a fluid or pasty medium to a continuous material web, particularly one made of paper or cardboard. The invention also relates to a special method of adjusting a longitudinal profile and/or cross section of a fluid or pasty medium directly or indirectly applied by such an application unit to the continuous material web.

An application unit according to the class is known from WO 93/05887 and comprises a support beam which extends in its longitudinal direction substantially across the entire width of the material web, a counter-roll opposite the support beam, a doctor element, in the form of a doctor blade, detachably secured via holding means to the support beam and extending substantially across the entire width of the counter-roll, and a pressing member disposed on the support beam and to which a pressing force is directly and/or indirectly applied by pressing means, and with which pressing member, the doctor blade in the region of its doctor blade tip mated with the counter-roll can be pressed against the counter-roll at a predetermined pressure. A thin shank angled by the upper end of a two-armed lever mechanism, which transfers the force of the pressing means designed as a pressure hose and disposed at the lower end of the lever mechanism, serves as a pressing member in this known prior art; this shank extends substantially at a right angle to the doctor blade when the application unit is viewed in cross section. The entire pressing mechanism primarily serves to adjust the longitudinal profile, i.e. the layer thickness of the applied fluid or pasty medium.

This structural design is, however, extremely complex and expensive and also results in various disadvantages when setting the doctor blade or the longitudinal profile. In consequence, the pressing member's arrangement and design not only frequently result in a deformation of the pressing member itself at higher pressures and hence in a change of the force vector originating from the pressing means, thereby producing a resultant adjustment error at the doctor blade, but the lever mechanism's adjusting movement necessary for altering the contact pressure also results in a not inconsiderable deviation of the contact point's position between the pressing member and doctor blade. This in turn results in an undesirable deflection or deformation of the doctor blade, an increase or decrease in the contact pressure and a change in the doctor blade's coating angle, thus impinging on the application's coating quality. Every time the doctor blade is adjusted by the pressing member, the usually non-linear dependency of doctor blade load and coating angle therefore causes a changing application weight and hence fluctuating coating qualities. A relatively large friction between these two parts also results from the aforementioned shift in contact point between pressing member and doctor blade, which conditions comparatively large adjusting forces or large profiling forces when setting the cross section. Disadvantageous hysteresis effects also arise in such a design. These negative phenomena are particularly marked if the lever mechanism or the holding means to which the thin shank acting as a pressing member is attached has a thin and elastic design. Finally, because this embodiment has a complex overall pressing mechanism design, such an embodiment has also proved to be highly prone to dirt accumulation and to entail complex cleaning and maintenance.

Another application unit comparable with the aforementioned prior art is shown in EP 0 512 971 A1. In this known embodiment, the pressing means is itself designed as the pressing member that makes direct contact with the doctor blade and to which the pressing force is applied. Two pressure hoses, which are superposed in the vertical direction when viewing the application unit in cross section at that side of the doctor blade facing away from the counter-roll, and which exert a contact force on the doctor blade, are used as pressing means or pressing members. This solution does, however, result in a very substantial deflection of the doctor blade and hence simultaneously results in an undesirable change in the doctor blade's coating angle when the contact pressure is increased.

SUMMARY OF THE INVENTION

The invention is therefore based on the object of providing an application unit according to the class and of providing a suitable method of adjusting a longitudinal profile and/or cross section of a fluid or pasty medium directly or indirectly applied by such an application unit to the continuous material web, avoiding as far as possible the problems encountered in the known prior art and allowing in a simple and effective manner an accurate adjustment of the doctor blade and hence of the coating profile of the fluid or pasty medium applied.

The application unit according to the invention is therefore characterized in that when viewed in cross section, the pressing member is formed as a parallelogram body supported at one end in or on at least one mount and extending essentially parallel to the doctor element. The three-dimensional pressing member therefore has essentially the form of an elongated parallelepiped. In principle, the doctor element may relate to any doctor element suitable for the intended purpose, such as a doctor blade, a doctor strip, a roller doctor element base with a roller doctor element, etc. The bearing or bearings themselves or other suitable holding or clamping means and the like may be used as a mount. In the sense of the invention, a counter-roll is to be defined both as an application roll to which the fluid or pasty medium is applied so as to produce an indirect application, and as a roll that supports the continuous material web, whereby the latter version has the fluid or pasty medium applied directly to the continuous web.

The application unit according to the invention allows, in a simple and effective manner, the doctor element and the coating profile to be adjusted accurately and therefore permits an improvement in the coating quality of the fluid or pasty medium applied to the counter-roll or to the material web running on the counter-roll. The design of the overall pressing mechanism, particularly the pressing member, can be simplified and hence designed inexpensively in a way that economizes on materials. The particular embodiment of the pressing member as a parallelogram body makes it possible to transfer the pressing force, which originates from the pressing means and is directed to the doctor element, to the doctor element in a parallel or linear manner without essentially altering the direction of its force vector. The considerable shift in position of the contact point between pressing member and doctor element which arises in conventional application units and the resultant undesirable changes in contact pressure and coating angle as well as disadvantageous blade-element deformations can therefore be effectively avoided and a high coating quality achieved with good reproducibility. As shall be explained in even more detail as follows, the application unit design according to the invention also allows the pressing force to be introduced into the doctor element in direct proximity to the end of the doctor element, which in turn positively affects the quality of the application to be produced using the application unit, reduces fluctuations in coating quality brought about by the setting and which is extremely beneficial to realize, particularly in the case of doctor blades. Disadvantageous hysteresis phenomena are minimized by the use of the parallelogram body according to the invention or do not make themselves felt. Moreover, the parallelogram body may advantageously perform functions of a profiling device for setting a cross section of the applied fluid or pasty medium, as shall be explained in even further detail as follows. The pressing member designed as a parallelogram body also represents an arrangement that is not prone to dirt accumulation and which is simple to clean and to maintain. The application unit according to the invention can on the whole be designed very compactly.

An advantageous embodiment feature of the invention provides for the parallelogram body in its simplest embodiment to comprise at least three individual members hingedly connected together, two individual members of which are equal in length, are spaced apart from each other in parallel and are hingedly secured at their respectively lower end to one of two bearings disposed at a predetermined distance from one another, and the third individual member of which hingedly connects the first two individual members together at their upper ends, whereby the length of the third individual member—when measured between the upper hinge points—corresponds to the gap between the two bearings of the first two individual members. A further, fourth individual member, which is not, however, absolutely necessary, can be inserted between the lower hinge points of the first two individual members. In the latter version, the parallelogram body therefore resembles a four-bar linkage, as is known for example from kinematics. The hinged connection of the respective individual members with one another and the hinged connection to a bearing may take place for example via fully articulated connecting members, hinges or by means of elastic, local thin sites in the material of the respective individual members or the like. Since the parallelogram body formed in this way is a structure which in itself is mobile, suitable stabilizing members can be provided which stabilize the parallelogram body in its resting position. A connection of the parallelogram body to the pressing means or an elastic support member may for example be used as such a stabilizing element.

It has also provided to be advantageous for the parallelogram body to be designed as an elastic spring member, against the restoring force of which the pressing means—starting from a neutral position of the parallelogram body—has a direct or indirect effect when this pressing means is activated, and which returns to the neutral position as a result of its restoring force when the pressing means is deactivated. In this manner, no additional adjusting movement of the pressing means is needed to return the parallelogram body to its neutral position and hence no such adjusting movement is required to relieve the doctor element of its load; the pressing means can therefore be designed in an uncomplicated way as a single-action pressing means.

The parallelogram body according to the invention can be practically realized to particularly beneficial effect in that when viewed in cross section, the parallelogram body has a sandwich-like structure with two plates spaced apart from one another and extending essentially in parallel and with at least two flat pieces disposed between the plates, spaced apart from one another in the vertical direction of the parallelogram body and connected to the plates, with the first flat piece being located in a lower portion of the parallelogram body and the second flat piece being located in an upper portion thereof. Surprisingly, this design has essentially the same properties as the above-described parallelogram body version produced from a plurality of individual members hingedly connected together. The sandwich-like parallelogram body also has an elastic spring effect, against which the pressing means, starting from a neutral position of the parallelogram body, has a direct or indirect effect when the pressing means is activated, so that when the pressing means is deactivated, the parallelogram body returns to the neutral position as a result of its restoring force. The parallelogram body's desired spring rigidity can be achieved in a simple manner by using stronger or thinner plates and/or by a specific thickness of the flat pieces arranged between the plates. Metal sheets are particularly suitable as plates, but in principle any other panel material is conceivable too, such as fiber-reinforced plastic plates or the like. The same goes for the choice of material of the aforementioned flat pieces. If such a parallelogram body is supported at its lower end in a mount, the upper edge of the mount preferably ends flush with the upper edge of the lower flat piece of the parallelogram body.

In terms of practical application, it has proved successful to design the thickness of the flat pieces disposed between the two metal sheets so as to be substantially greater than the thickness of the metal sheets themselves.

Depending on the particular material used for the flat pieces or metal sheets or a corresponding combination of materials, the flat pieces can be affixed, soldered, welded, riveted or screwed to the metal sheets or they may be connected in any other suitable manner thereto.

According to another advantageous embodiment feature of the invention, there is provision for the upper flat piece to be divided segmentally across the longitudinal extension of the parallelogram body. It is not, however, absolutely necessary to divide the plates bordering the flat pieces. The segmental division of the upper flat piece is preferably formed by one or more separating lines attached in the upper flat piece, laterally spaced apart from one another and extending essentially vertically. These separating lines can be formed both as partial incisions in a continuous upper flat piece or as separating lines which divide the upper flat piece into a plurality of individual members separated from each other by the respective separating lines. The two aforementioned embodiment versions of the upper flat piece can also be combined.

In this connection, it has also proved to be advantageous for the upper edge portion of the parallelogram body to be segmentally divided across its longitudinal extension and to form two or more tongue-like edge elements. This segmental division can also be achieved by vertical separating lines or incisions, although in contrast to the previously described exemplary embodiment that relates to the upper flat piece, these separating lines or incisions also extend through at least one of the sandwich-like plates bordering the flat pieces. The segmental division of both the flat piece of the parallelogram body and of the upper edge portion of the overall parallelogram body itself is particularly beneficial for adjusting a cross section of the applied fluid or pasty medium, as shall also be explained in the following.

According to another embodiment of the application unit according to the invention, there is provision for the upper edge of the parallelogram body to be fitted with a support lug angled toward the doctor element; this support lug can make contact with the doctor element in immediate proximity to that end of the doctor element mated with the counter-roll (i.e. for example the tip of a doctor blade) and transfers those pressing forces which originate from the pressing means directly or indirectly to the doctor element. An indirect transfer of the pressing forces is for example present if at least one force-transferring component is also interposed between the pressing means and the support lug or parallelogram body itself. The support lug preferably extends at a right angle to the vertical direction of the parallelogram body. The support lug enables the parallelogram body and hence the pressing means which takes effect on the parallelogram body to be disposed further away from the blade-element end or the counter-roll, thus simultaneously allowing the contact point between the doctor element and the support lug tip that makes contact with the doctor element to be placed very close to the free end of the doctor element, which as already mentioned at the outset, has a positive effect on the coating quality of the application.

It has also proved beneficial for the support lug to constitute an integral component of the parallelogram body. It is, however, also provided according to another design version that the support lug represents at least a separate part which is secured on or to or in the upper free edge of the parallelogram body. This attachment is expediently designed such that the support lug can be easily detached from the parallelogram body.

The support lug can in principle be produced from any suitable material. If a relatively soft material, such as plastic, is used, it has however proved to be an advantage for the support lug to be provided with a wear-resistant contact surface on its lug tip in order to make contact with the doctor element. A metal profile inserted into the support lug tip is particularly suitable as such a wear-resistant contact surface.

As regards positioning the support lug tip which makes contact with the doctor element, it is also advantageous for the support lug to taper toward its tip. Such a tapering can be achieved either by symmetrically or asymmetrically designed profiled portions of the support lug. The tapering may also extend continuously or discontinuously. For instance, the tapering can be achieved by a bevel attached to the upper or lower side, i.e. that side of the support lug facing toward or away from the counter-roll. This bevel then allows the support lug to be disposed close to the counter-roll, thereby allowing the contact point between the support lug tip and the doctor element to be placed in direct proximity to the doctor element (i.e. the doctor blade tip if a doctor blade is used).

According to a positive embodiment version of the invention, the support lug extends continuously, i.e. without division, across substantially the entire web width of the application unit.

With respect to the adjustment of a cross section of the applied fluid or pasty medium, at least one portion of that region of the support lug which adjoins the upper edge of the parallelogram body is segmentally divided, whereas that edge of the support lug mated with doctor blade, and hence the support lug tip, extends continuously across substantially the entire web width of the application unit. This modification is particularly suitable in conjunction with the above-described formation of tongue-like edge members in the upper edge of the parallelogram body or with the segmental division of the upper spacer of a parallelogram body built up like a sandwich. If the segmental division of the latter components is achieved for example by means of separating lines or incisions, these separating members expediently continue into that region of the support lug adjoining the upper edge of the parallelogram body.

It has, however, also proved advantageous with regard to certain applications and profiling tasks for the entire support lug to be segmentally divided, thereby making it easier for the parallelogram body to be zonally and elastically deformed in order to set a desirable cross section.

In the case of conventional dimensions for an application unit, a distance of the support lug/doctor element contact point from that free end of the doctor element mated with the counter-roll has proved beneficial if it is in a range of about 2 to 30 mm, and in turn if there is a gap particularly in the range of about 3 to 20 mm. The invention is not, however, restricted to these values, on the contrary it is possible to diverge considerably from these data, depending on the actual application.

To make assembly and disassembly easier, it is an advantage for the support lug designed as a separate component—when viewed in cross section—to comprise a claw-like portion, with which this lug is mounted and/or secured onto the upper free edge of the parallelogram body.

Another advantageous embodiment feature of the invention envisages that the rear side of the support lug facing away from the doctor element comprises the pressing means. In technical terms, this can be brought about particularly easily in that the rear side of the support lug facing away from the doctor element comprises a suitable adapter in order to create a connection with the pressing means. This adapter is preferably designed such that the pressing means can be easily detached from the support lug.

In accordance with another advantageous embodiment version, the application unit according to the invention is also designed such that the vector of the pressing force which starts from the pressing means through the contact point between the parallelogram body and doctor element or the contact point between the support lug and the doctor element and in the parallelogram body's neutral position runs essentially at a right angle to its vertical extension. This not only makes a linear flow of force possible, which is beneficial in structural design terms, but also enables a transfer of force to the doctor element, in which the pressing force that starts from the pressing means and is guided to the doctor element is transferred in a parallel or linear manner to the doctor element without substantially altering the direction of its force vector. In this way, the pressing force acting on the doctor element does not obtain any component that deviates from the intended direction of force and which might adversely affect, in the initially explained manner, the doctor element adjustment.

According to another embodiment feature of the invention, the pressing means is disposed on that side of the parallelogram body facing away from the counter-roll, whereby an attachment site which is located between the parallelogram body and a thrust bearing secured to the support beam is particularly suitable. There is also provision for the pressing means to be secured to the thrust bearing connected to the support beam or for it to be secured to a part corresponding thereto.

With regard to specific applications, it is also beneficial for the pressing means to engage with the parallelogram body in a central and/or upper portion thereof.

A pressure hose and/or pressure pad to be actuated pneumatically has proved to be particularly successful as a pressing means. But in principle any other suitable pressing means can also be used, such as mechanical, hydraulic, electrical, magnetic pressing means and the like.

To achieve a high coating quality, it has also proved to be beneficial for the application unit to comprise a profiling means too in order to adjust a cross section of the applied fluid or pasty medium. If suitably designed, this profiling means may be the aforementioned pressing means itself or a separate device.

In the region of the upper edge of the parallelogram body, the profiling means preferably engages directly and/or indirectly therewith and exerts upon the parallelogram body a contact pressure that is even or which differs across various parallelogram body portions and which is respectively locally limited. A cross section of the applied fluid or pasty medium is therefore adjusted by zonally setting the parallelogram body using the aforementioned profiling means.

If the profiling means represents a component that does not depend on the actual pressing means and which is used in combination with the pressing means, the pressing means is preferably positioned so as to engage with the parallelogram body in a central portion thereof. In this version, the longitudinal profile and cross section can accordingly be set independently of one another, with the pressing means being responsible for longitudinal profile adjustment and the profiling means being responsible for cross sectional adjustment.

If, however, the pressing means also performs the function of the profiling means so as to adjust a cross section, both the cross section and the longitudinal profile of the applied medium can be manipulated by a single component.

Similar to the pressing means, there is also provision in the profiling means for the vector of a pressing force—which starts from the profiling means and is assigned to a specific partial portion of the parallelogram body—through the parallelogram body/doctor element contact point or the support lug/doctor element contact point and in the parallelogram body's neutral position to run substantially at a right angle to its vertical extension.

If the pressing means is used in combination with a separate profiling means, it has proved successful for the profiling means to engage particularly in a central portion of the parallelogram body, while the pressing means engages directly and/or indirectly with the parallelogram body in the region of the upper edge thereof and to exert in the aforementioned manner a pressing force upon the parallelogram body which in turn transfers this pressing force to the doctor element.

In general, a configuration that is the exact reverse can, however, also be adopted.

According to a further advantageous embodiment feature of the invention, it is envisaged that the profiling means comprises a plurality of individual actuators which are each assigned to one or more of the segmental divisions of the parallelogram body or the segmental divisions of the parallelogram body's support lug. The cross section of the fluid or pasty medium to be applied can therefore be adjusted in a systematically zonal manner. This embodiment is particularly appropriate in the case of a pressing means which also assumes the functions of a profiling means in order to adjust a cross section.

The individual actuators of the profiling means relate for example to mechanical, pneumatic, hydraulic, electrical, magnetic, electromagnetic, thermal, electrothermal actuators and the like as well as combinations thereof. In accordance with the invention, electrical actuators also comprise those based on inductive effect or eddy current effects and which exert a force on the parallelogram body or influence same for example on the basis of a thermal effect caused by induction and from which there in turn results an adjusting effect of the parallelogram body. Thermal actuators are also to be defined as those which achieve a thermal effect as a result of the action of radiation or a heated or cooled fluid or pasty medium upon the parallelogram body. Double-action pneumatic cylinders are particularly preferred individual pneumatic actuators, since they enable a variety of approaches and control concepts suitable for adjusting both a longitudinal profile and a cross section.

In this connection, it has also proved to be beneficial for at least one of the individual actuators to be disposed in or on at least one of the lateral faces of the parallelogram body. For instance, if the aforementioned sandwich-design parallelogram body is used, a heating element on that side of the parallelogram body facing away from the doctor blade can be affixed to the outer plate of the body and when there is a temperature rise or fall, may produce a change in this plate's length with respect to that plate facing toward the doctor element and hence may cause a locally limited adjusting movement that can be utilized for setting a cross profile of the applied fluid or pasty medium. A comparable effect can be achieved if at least one of the two outer plates of the sandwich-like parallelogram body is manipulated by the effect of an eddy current or by leading past a heated or cooled fluid or gaseous medium.

The application unit according to the invention also advantageously comprises at least one control and/or regulating means for the controlled adjustment of the pressing forces of the pressing means and/or the profiling means. This allows the application unit to be adapted to changing operating conditions, particularly enabling the doctor element's contact pressure to be altered easily and to adjust both the longitudinal profile and the cross section of the applied fluid or pasty medium not only during continuous operation but also during a stoppage, depending on various parameters.

In this method according to the invention for adjusting a longitudinal profile and/or cross section of a fluid or pasty medium directly or indirectly applied by means of the application unit according to the invention to a continuous material web, particularly one made of paper or cardboard, the longitudinal profile and/or cross section is adjusted by controlled, dependent or independent effects of force of the pressing means and/or the profiling means upon the parallelogram body which correspondingly transfers these effects of force to the doctor element, thereby realizing the respectively desired profiled shape. The method according to the invention makes possible the advantages already discussed in detail in conjunction with the application unit according to the invention.

According to the method of the invention, a respective adjustment of the longitudinal profile and/or cross section need not inevitably be achieved by the joint interaction of the pressing means and the profiling means, but it is also provided in accordance with the invention that at least one of these two devices assumes both adjustment tasks, whereby the respectively second device may be in an inactive state. This will be discussed in further detail as follows. It is just as self-evident that an adjustment of the cross section need not necessarily be performed if the application to the continuous material web by itself meets the requirements expected of a desired cross section.

When a longitudinal profile is adjusted by the pressing means, the effect of force of the pressing means upon the parallelogram body inevitably substantially extends across the entire width of the material web.

As already implicitly emerges from the preceding description of the application unit, the force of the profiling means takes effect upon the parallelogram body in a preferably zonal or locally restricted manner. This embodiment feature of the method according to the invention can be accomplished particularly advantageously in the case of a parallelogram body whose upper lateral edge or whose upper flat piece is segmentally divided across the parallelogram body's longitudinal extension. The zonally or locally limited effect of force can then be preferably exerted by an individual profiling-means actuator assigned to the respectively formed segment.

Three preferred versions of the method have proved particularly successful with regard to the practical operation of the application unit according to the invention, although the invention is not limited thereto.

In the first version of the method, the adjustment of the longitudinal profile takes place using the pressing means, and the adjustment of the cross section takes place using the profiling means. In particular there is provision for the adjustment of the longitudinal profile to take place by producing a predetermined effect of force of the pressing means (e.g. a pneumatic pressure hose) upon the parallelogram body across essentially the entire web width, and the adjustment of the cross section takes place by starting from a forceless state of the individual actuators (e.g. pneumatic pressure pads) of the profiling means by applying a positive effect of force of the individual actuators upon the parallelogram, with this positive effect of force being added to the pre-specified effect of force of the pressing means. If for example a pressure hose is therefore used as a pressing means and a plurality of pressure pads is used as a profiling means, adjustment of the longitudinal profile takes place solely by applying a predetermined pressure to the pressure hose, this pressure being transferred to the doctor element via the parallelogram body, whereas the pressure pads are for the time being depressurized and only when required are they activated individually or as a plurality and only in order to adjust a cross section, i.e. a pressure is applied thereto. An individual pressure pad can therefore only locally increase, but not decrease the contact pressure exerted upon the doctor element via the parallelogram body.

In the second version of the method, the longitudinal profile is adjusted by the pressing means and the profiling means, and the cross section is adjusted by the profiling means. The pressing means and the profiling means therefore jointly effect a specific longitudinal profile, with the profiling means assuming partial functions of the pressing means. In this regard, there is particular provision for the longitudinal profile to be adjusted by producing a predetermined average effect of force of all the individual actuators of the profiling means upon the parallelogram body across essentially the entire web width and by optionally producing (i.e. if required) a predetermined effect of additional force of the pressing means upon the parallelogram body across essentially the entire web width. The aforementioned predetermined average effect of force and the optionally produced effect of additional force are added up to a necessary effect of total force. If need be, the cross section is then adjusted by positive and/or negative deviation of the effect of force of one or more individual actuators of the profiling means from the above predetermined average effect of force. If for example a pressure hose is therefore in turn used as a pressing means and a plurality of pressure pads is used as a profiling means, the longitudinal profile is adjusted in that the same average pressure is first applied to all the pressure pads, thereby effecting a certain pre-adjustment of the longitudinal profile. The pressure hose which applies the necessary additional pressure across the entire machinery width is then activated; this additional pressure, together with the preset pressure of the pressure pads, is needed to adjust the desired longitudinal profile correctly. The aforementioned application of pressure to the pressure pads and the pressure hose can of course be performed in reverse order as well. An adjustment of the cross section is particularly simple to perform by means of a positive and/or negative alteration—based on the preset average pressure—of the pressure of individual or of several pressure pads, with it being possible to regulate the fluid or pasty medium when either too much or too little has been applied.

In the third version of the method, the longitudinal profile and/or cross section is adjusted simply using the profiling means. This profiling means therefore assumes tasks of the aforementioned pressing means which can be deactivated or even omitted. In this regard, it is particularly provided for the longitudinal profile to be adjusted by producing a predetermined effect of force of all the individual actuators of the profiling means upon the parallelogram body across essentially the entire web width, and for the cross section to be adjusted by positive and/or negative deviation of the effect of force of one or several individual actuators from this predetermined effect of force. If in other words a plurality of pressure pads is for example used as a profiling means, the longitudinal profile is adjusted by applying pressure to all the pressure pads across essentially the entire web width and the cross section is adjusted by a positive and/or negative alteration—based on the preset pressure—of pressure of individual or several pressure pads.

In the method according to the invention, the adjustment of the longitudinal profile and/or cross section is preferably performed with the assistance of the previously described control and/or regulating means of the application unit according to the invention.

BRIEF DESCRIPTION OF THE DRAWINGS

Preferred exemplary embodiments of the invention with additional design aspects and other advantages will be described and explained in more detail with reference to the attached drawings as follows.

Unless further differentiation is necessary, identical components will also be identified by identical reference numerals in the following description and Figures in order to avoid repetitions.

DETAILED DESCRIPTION OF THE INVENTION

Figure 1:
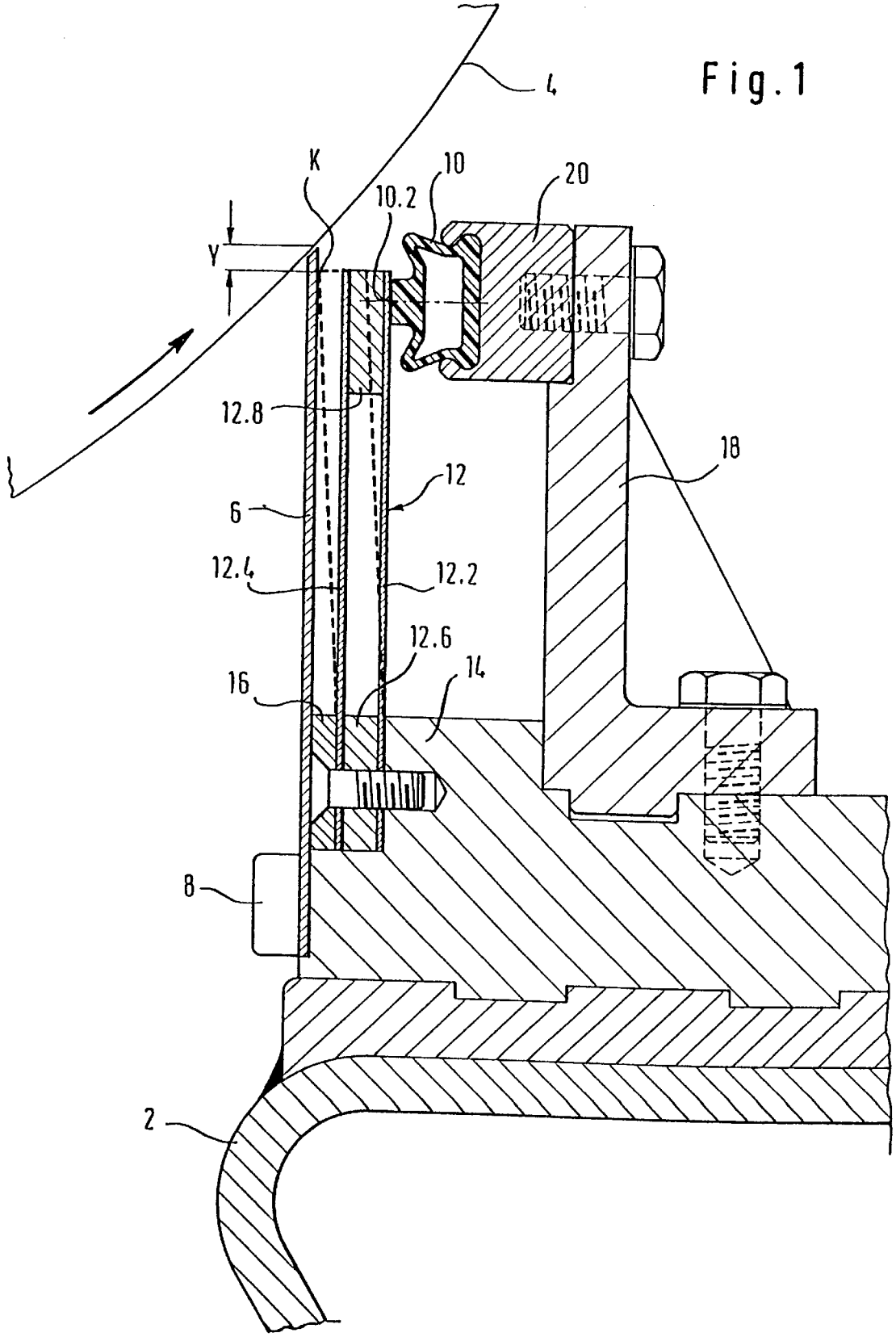
FIG. 1 shows a schematic cross-sectional representation of a first exemplary embodiment of the application unit according to the invention, FIG. 2 a schematic perspective view of the parallelogram body of the embodiment according to FIG. 1, FIG. 3*a* a schematic cross-sectional representation of a second exemplary embodiment of the application unit according to the invention, FIG. 3*b* a schematic detailed side view of the parallelogram body depicted in FIG. 3*a*, FIG. 4 a schematic cross-sectional representation of a third exemplary embodiment of the application unit according to the invention, FIG. 5 a schematic cross-sectional representation of a fourth exemplary embodiment of the application unit according to the invention, FIG. 6 a schematic cross-sectional representation of a fifth exemplary embodiment of the application unit according to the invention, FIG. 7 a schematic cross-sectional representation of a sixth exemplary embodiment of the application unit according to the invention FIG. 8 a schematic cross-sectional representation of a seventh exemplary embodiment of the application unit according to the invention, FIG. 9 a schematic diagram of the actuator configuration of the application unit according to FIG. 8 as part of a schematic horizontal projection, and FIG. 10 a schematic cross-sectional view of another embodiment of a parallelogram body as used in the application units of FIGS. 3*a,* 6, 7 and 8.

A first exemplary embodiment of the application unit according to the invention for directly or indirectly applying a fluid or pasty medium to a continuous material web, particularly one made of paper or cardboard, can be inferred from FIG. 1 in a schematic cross-sectional representation. The application unit comprises a support beam 2 extending in its longitudinal direction substantially across the entire width of the material web, and a counter-roll 4 opposite the support beam 2 and the rotary direction of which is indicated by an arrow. This counter-roll 4 may relate to an application roll for producing an indirect application or to a roll that supports the material web, with the fluid or pasty medium being directly applied to the continuous material web in the latter case. A doctor element 6 extending substantially across the entire width of the counter-roll 4 is detachably secured to the support beam 2 at that lateral edge of the support beam 2 which faces toward the counter-roll 4. It is assumed in the following description that the doctor element 6 relates to a doctor blade 6, although the invention is not restricted to this type of doctor element. The doctor blade 6 is attached via a suitable holding or securing means 8, whose depiction is only implied in the drawing. The application unit also comprises a pressing member 12 that is disposed on the support beam 2 and to which a pressing force is applied directly by a pressing means designed as pressure hose 10 and with which the doctor blade 6 can be pressed, in the region of its doctor blade tip mated with the counter-roll 4, against the counter-roll 4 at a predetermined pressure in order to adjust in this manner the layer thickness or a longitudinal profile of the applied fluid or pasty medium.

As can also be easily identified in FIG. 1, the pressing member 12, when viewed in cross section, as portrayed in the drawing, is formed as a parallelogram body 12 which is supported at its lower end within a mount 14 that forms part of the support beam 2 in the present instance; this parallelogram body extends at a predetermined slight distance from and essentially parallel to the doctor blade 6 in a neutral position of the doctor blade 6, i.e. in a position in which the doctor blade 6 is not burdened by the pressing member 10. In the present case, this distance corresponds to the thickness of a separator 16 disposed between the doctor blade 6 and the parallelogram body 12. The parallelogram body 12 has a sandwich-like structure having two spaced apart and essentially parallel outer metal sheets 12.2, 12.4 and two flat pieces 12.6, 12.8 disposed between the outer metal sheets 12.2, 12.4 and spaced apart from one another in the vertical direction of the parallelogram body 12 and connected to the outer metal sheets 12.2, 12.4, the first flat piece 12.6 being located in a lower portion of the parallelogram body 12 and the second flat piece 12.8 being located in an upper portion thereof. The upper and lower edges of the flat pieces 12.6, 12.8 each terminate flush with the upper or lower edge of the two outer metal sheets 12.2, 12.4. A material numbered 1.4310 is used for the outer metal sheets 12.2, 12.4, and a material numbered 1.4571 is used for the spacers 12.6, 12.8. The flat pieces 12.6, 12.8 are affixed to the outer metal sheets 12.2, 12.4 in the present exemplary embodiment.

The parallelogram body 12 is therefore designed as an elastic spring member, against the restoring force of which the pressure hose 10—when activated—has a direct effect, starting from the neutral position of the parallelogram body 12, as illustrated in FIG. 1, and which returns to the neutral position as a result of its restoring force when the pressure hose 10 is deactivated.

In the present case, the pressure hose 10 is disposed at that side of the parallelogram body 12 facing away from the counter-roll 4 between the parallelogram body 12 and a thrust bearing 18 secured to the support beam 2 and this hose is fixed to the thrust bearing 18 via a spacer 20 supporting the pressure hose 10. The arrangement of the pressure hose 10 is chosen such that its contact surface 10.2 comes into contact with the upper edge of the parallelogram body 12. When the pressure hose 10 is activated by a pressure generating device known per se and not represented in the drawings, the parallelogram body 12 is moved toward the doctor blade 6, as indicated by the thick broken line in FIG. 1, and makes contact K therewith in the region of its doctor blade tip mated with the counter-roll 4, causing the doctor blade 6 to be pressed against the counter-roll 4 at a predetermined pressure. The distance Y between the doctor blade tip and the upper edge of the parallelogram body 12 amounts to about 5 to 8 mm.

Figure 2:
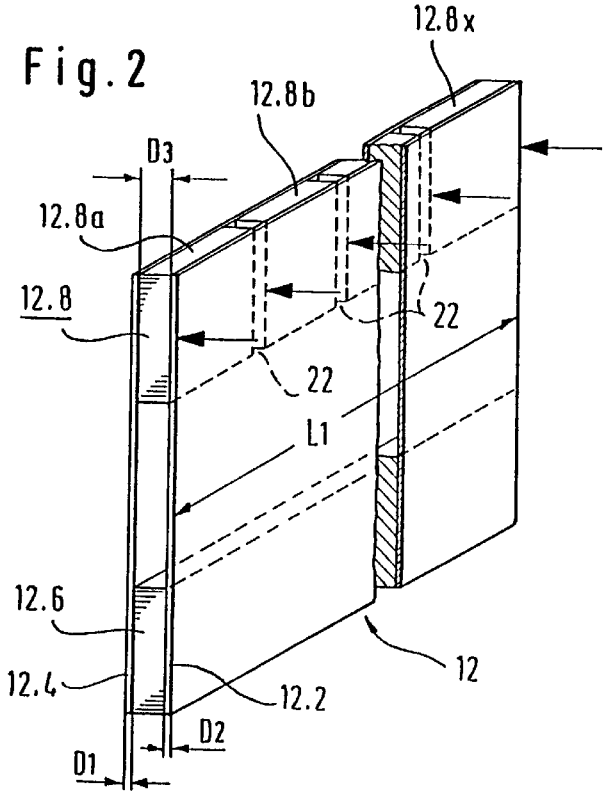

Further details of the parallelogram body 12 can be inferred from FIG. 2 which depicts a schematic perspective view of the parallelogram body 12 of the embodiment according to FIG. 1. The component dimensions of the parallelogram body 12, as selected for the given exemplary embodiment, are such that in the present case, the thickness D3 of the flat pieces is much larger than the thickness D1, D2 of the outer metal sheets 12.2, 12.4. Since the width of the material web to be coated or the width of the counter-roll 4 usually amounts to several meters in conventional application unit dimensions, the parallelogram body 12 is built up from several identically structured, individual parallelogram-body members 12 arranged side by side and having the length L1. A continuous parallelogram body can, however, equally be used. According to FIG. 2, the upper flat piece 12.8 of the parallelogram body 12 is segmentally divided across the longitudinal extension of the parallelogram body 12. The division is produced by a plurality of separating lines 22 attached within the upper flat piece 12.8, laterally spaced apart from one another and extending essentially vertically, dividing the upper flat piece 12.8 into a plurality of laterally adjacent individual flat-piece members 12.8*a,* 12.8*b* . . . 12.8*x*. As can be clearly identified in FIG. 2, the outer metal sheets 12.2, 12.4 that border the flat pieces 12.6, 12.8 do not have any such division, but extend continuously across the individual flat-piece members 12.8*a,* 12.8*b* . . . 12.8*x*—separated from each other by the respective separating lines 22—of the upper flat piece 12.8. Such a design is used to adjust a specific cross section of the applied fluid or pasty medium, as shall be further explain ed in the following. The parallelogram body 12 according to the embodiment in FIGS. 1 and 2 is rated for a maximum line load of 5 N/mm. The line load acting upon the parallelogram body 12 is indicated in FIG. 2 by several arrows.

Figure 3A:
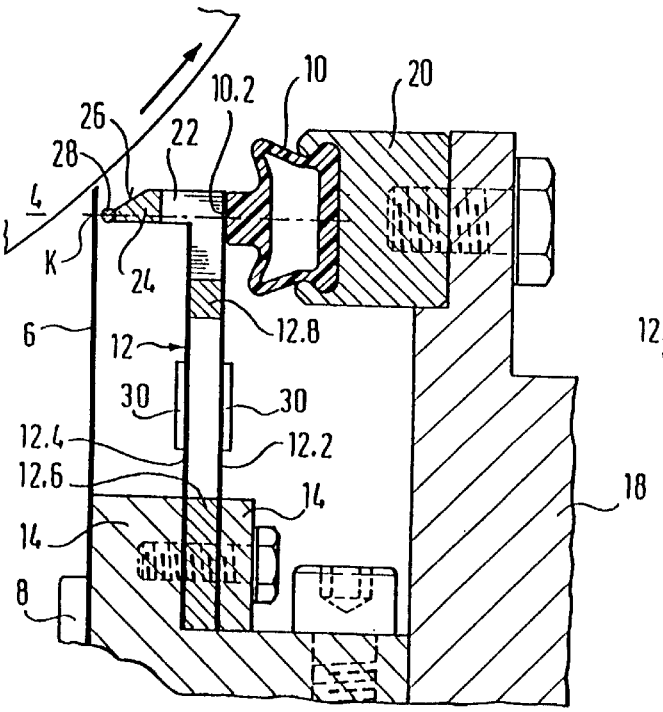

FIG. 3*a* shows a schematic cross-sectional representation of a second exemplary embodiment of the application unit according to the invention. In terms of the basic structure, this version essentially corresponds to that according to FIG. 1, but in contrast thereto, the upper edge of the parallelogram body 12 is fitted with an integral support lug 24 angled toward the doctor blade 6; this lug can make contact with the doctor blade 6 in direct proximity to the doctor blade tip mated with the counter-roll 4 and directly transfers the pressing forces, which originate from the pressure hose 10, to the doctor blade 6. The support lug 24 extends substantially at a right angle to the vertical direction of the parallelogram body 12. On account of this support lug 24, the lateral distance between the doctor blade 6 and the parallelogram body 12 is greater than in the embodiment according to FIG. 1. It can also be inferred from FIG. 3*a* that the upper side of the support lug 24 facing toward the counter-roll 4 is provided with a bevel 26 such that the support lug 24 tapers toward its tip. At its tip, the support lug 24 is provided with a wear-resistant contact surface 28 in the form of a suitable metal profile 28 inserted into the tip of the support lug 24 and which in the present instance is rounded off so as to make contact with the doctor blade 6.

Figure 3B:
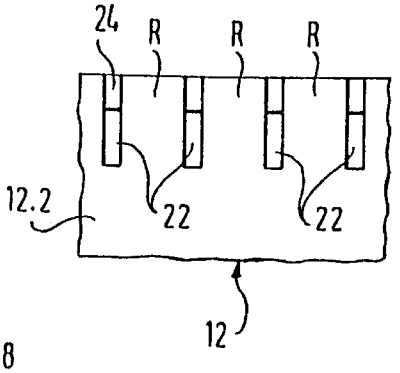

In the embodiment according to FIG. 3*a,* the upper edge portion of the parallelogram body 12 is also segmentally divided across its longitudinal extension, thereby forming a plurality of tongue-like edge members R, as is more clearly apparent from FIG. 3*b,* which shows a schematic detailed side view of the parallelogram body depicted in FIG. 3*a*. This division into tongue-like edge members R essentially corresponds to the division represented in FIG. 2, but the separating lines 22 do not extend completely through the upper flat piece 12.8, i.e. the flat-piece portions separated by the separating line 22 are still connected together by the lower edge of the upper flat piece 12.8, and the separating lines 22 also extend through the outer metal sheets 12.2, 12.4 bordering the flat pieces 12.6, 12.8. That region of the support lug 24 adjoining the upper edge of the parallelogram body 12 is likewise segmentally divided by a continuation of the aforementioned separating lines 22, whereas that edge of the support lug 24 mated with the doctor blade 6 extends continuously, i.e. without division, across essentially the entire web width or width of the counter-roll 4. The segmental division makes it easier to adjust a cross section of the applied fluid or pasty medium by zonally setting the respective segment portions or tongue-like edge portions R of the parallelogram body 12.

For this purpose, the application unit comprises, in addition to the pressure hose 10, a profiling means in the form of heating elements 30 secured in a central portion of the parallelogram body 12 on its outer faces, i.e. on the outer metal sheets 12.2, 12.4, with preferably a single heating element 30 being mated with a single segmental portion or tongue-like edge member R of the parallelogram body 12. By heating and/or cooling individual heating elements 30, a change in length of an outer panel 12.4 with respect to the respectively other outer panel 12.2 of the parallelogram body 12 is for example achieved, and these changes in length bring about a locally limited adjusting movement that can be utilized for setting a cross section of the applied fluid or pasty medium regardless of a pressing force generated by the pressure hose 10.

In the embodiment according to FIG. 3*a,* the pressure hose 10, parallelogram body 12, its support lug 24 and the doctor blade 6 are disposed in relation to one another such that the vector of that pressing force which starts from the pressure hose 10 through the contact point K between support lug and doctor blade and in the neutral position of the parallelogram body 12, as shown in FIG. 3*a,* extends substantially at a right angle to its vertical extension. The vector of the pressing force thereby extends substantially along the horizontal dot-dashed line shown in FIG. 3*a*. In this way, starting from the pressure hose 10, the flow of force runs in a linear manner through the support lug 24 of the parallelogram body 12 and across the contact point K between support lug and doctor blade to the doctor blade 6. The direction of the force vector therefore does not undergo any change in direction, but is at most shifted in parallel to a minimum degree in the vertical direction without producing a force component that takes effect in the vertical direction.

Figure 4:
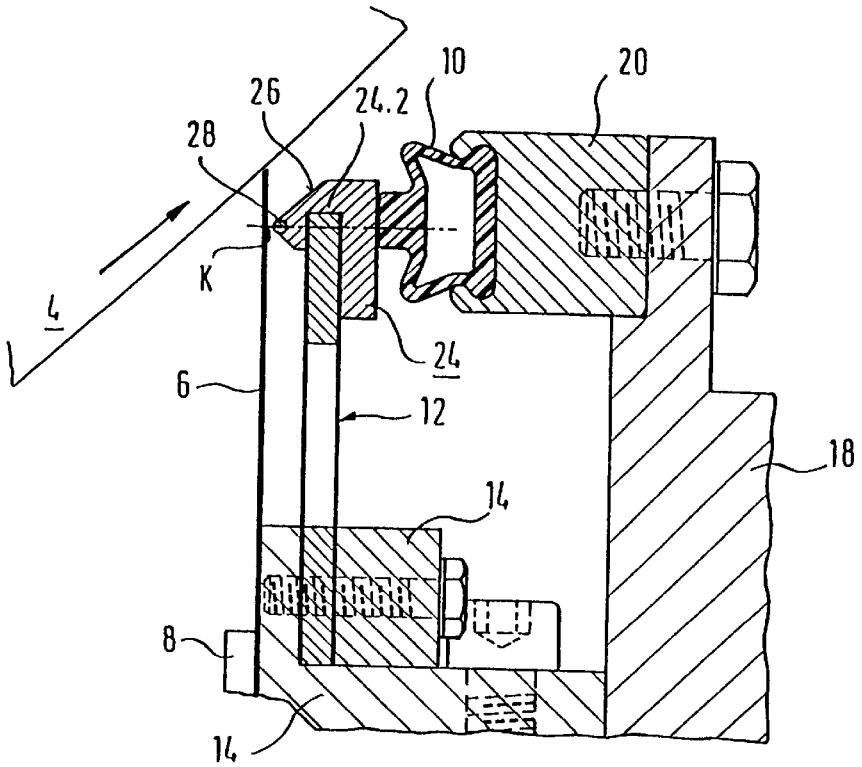

FIG. 4 shows a schematic cross-sectional representation of a third exemplary embodiment of the application unit according to the invention. In this version, the support lug 24 of the parallelogram body 12 is formed as a separate part secured to the upper free edge of the parallelogram body 12. As can be identified in FIG. 4, the support lug 24 comprises a claw-like portion 24.2 surrounding the upper edge of the parallelogram body 12, thereby securing the support lug 24 to the parallelogram body 12.

Figure 5:
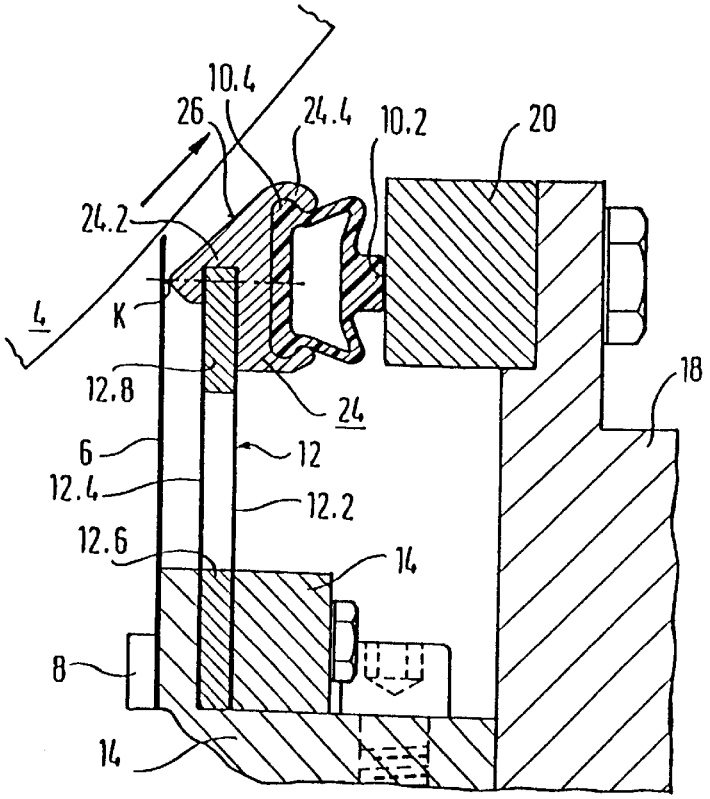

FIG. 5 shows a schematic cross-sectional representation of a fourth exemplary embodiment of the application unit according to the invention. The basic structure of this modification essentially corresponds to that according to FIG. 4, but in contrast thereto, the pressure hose 10 is secured to the rear side of the support lug 24 which is facing away from the doctor blade 6. The attachment takes place via a C-shaped profiled portion 24.4 provided in the rear side of the support lug and corresponding to a corresponding edge portion 10.4 of the pressure hose 10, thus acting as an adapter for producing a connection with the pressure hose 10. When the pressure hose 10 is activated, its contact surface 10.2 makes contact with the spacer 20 of the thrust bearing 18 disposed on the support beam 2, and the reaction causes the tip of the support lug 24 to make contact K with the doctor blade 6 analog to the manner explained above, thereby transferring the pressing force to the doctor blade 6.

FIG. 6 shows a schematic cross-sectional representation of a fifth exemplary embodiment of the application unit according to the invention. This embodiment essentially corresponds to that according to FIG. 3, but in contrast thereto, it uses a pressing means which can simultaneously perform the function of a profiling means so as to adjust a cross section of the applied fluid or pasty medium or vice versa. For this purpose, the pressing means that acts upon the parallelogram body 12 is formed from a plurality of pressure pads 32 laterally arranged side by side and which can make contact with the upper edge portion of the parallelogram body 12 and which are to be actuated in a manner dependent on and/or independent of one another. A single pressure pad 32 is preferably assigned to one segmentally divided portion respectively of the support lug 24 or a tongue-like edge member R of the parallelogram body 12. When one or more pressure pads 32 is/are activated, a contact pressure which directly acts upon the parallelogram body 12 and is locally limited portion by portion is therefore exerted in the region of the upper edge of the parallelogram body 12; this contact pressure is transferred via the tip of the support lug 24 to the doctor blade 6. This makes it possible to adjust both a desirable longitudinal profile and a desirable cross section of the fluid or pasty medium applied. Just such a result can be achieved by deactivating one or more pressure pads 32.

To adjust a specific longitudinal profile of the applied fluid or pasty medium, all the pressure pads 32 can for example be activated and a respectively equal pressure applied thereto, so that the pressure pads 32 exert a predetermined and even effect of force upon the parallelogram body 12 across essentially the entire web width. The adjustment or regulation of the cross section can then be achieved, starting from the predetermined effect of force, i.e. the predetermined equal pressure, by a positive and/or negative deviation of pressure of one or more pressure pads 32. A negative deviation of pressure of a single pressure 32 may also occur by completely deactivating this pressure pad.

As indicated in FIG. 6 by a horizontal dot-dashed line, the application unit in this embodiment is also rated such that the vector of the pressing force which starts from the profiling means 32, i.e. the pressing means 32 acting as a profiling means, and assigned to a specific partial portion of the parallelogram body 12 through the contact point K between the support lug and doctor blade and in the neutral position of the parallelogram body 12, as depicted in FIG. 6, runs essentially at a right angle to its vertical extension.

FIG. 7 shows a schematic cross-sectional representation of a sixth exemplary embodiment of the application unit according to the invention. In this version, the pressing means responsible for adjusting the longitudinal profile of the applied fluid or pasty medium is formed separately from the profiling means so as to adjust the cross section. A pressure hose 10 in the configuration already explained in conjunction with FIGS. 1 and 3 is again used here as a pressing means. The pressure pads 10 which were already explained in conjunction with FIG. 6 but which now engage with the parallelogram body 12 in a central portion thereof serve as a profiling means so as to adjust the cross section. A version in which the arrangement is exactly the opposite to that shown in FIG. 7 can equally be implemented, i.e. the pressure pads 32 are located in a position comparable with FIG. 6, while the pressure hose 10 which serves as pressing means engages with the parallelogram body 12 in a central portion thereof.

The embodiment according to FIG. 7 is particularly well suited to the two versions of the method to be explained as follows in order to adjust the longitudinal profile and/or cross section of the applied fluid or pasty medium.

In the first version, the longitudinal profile is adjusted solely by means of the pressure hose 10 and the cross section is adjusted solely by means of the pressure pads 32. A predetermined pressure, which exerts a predetermined even effect of force upon the parallelogram body 12 across essentially the entire web width, thereby adjusting the desired longitudinal profile of the applied fluid or pasty medium, is therefore applied to the pressure hose 10. In doing so, the pressure pads 32 can be held in a depressurized state for the time being. If it becomes necessary to adjust or regulate the cross section, individual or several pressure pads 32 are, however, activated by the application of pressure, starting from their depressurized state, thereby producing a positive effect of force upon the parallelogram body 12; this effect is respectively locally added to the predetermined effect of force of the pressure hose 10. It is of course just as feasible to deactivate a respective pressure pad 32 once again in order to achieve a local cross-sectional change at the site of the pressure pad 32. Because a pressure pad 32 is activated, starting from a depressurized state, this pad can therefore only locally increase, but not decrease, the contact pressure exerted upon the doctor element 6 via the parallelogram body 12.

In the second version, the longitudinal profile is adjusted by the pressure hose 10 and the pressure pads 32 in unison, while the cross section is adjusted solely by means of the pressure pads 32. To adjust a desired longitudinal profile, the same predetermined average pressure is first applied to each of the pressure pads 32, thereby causing the longitudinal profile to be adjusted to a certain extent across the entire web width. The pressure hose 10, which creates an even, additional pressure across the entire machinery width, is then activated; together with the predetermined average pressure of the pressure pads 32, this additional pressure ensures a correct final adjustment of the desired longitudinal profile. The predetermined average pressure of the pressure pads 32 and the additional pressure created by the pressure hose 10 are therefore locally added up to a total effect. The aforementioned activation of the pressure pads 32 and pressure hose 10 can, of course, be performed in reverse order as well. If necessary, a cross-sectional adjustment is achieved by a positive and/or negative change in pressure—starting from the pre-set average pressure—of individual or several pressure pads 32, with it being possible to regulate either too great or too small an application quantity of a fluid or pasty medium. Of course, it is also possible for individual pressure pads 32 to keep their pre-set average pressure constant during cross-sectional adjustment.

Figure 8:
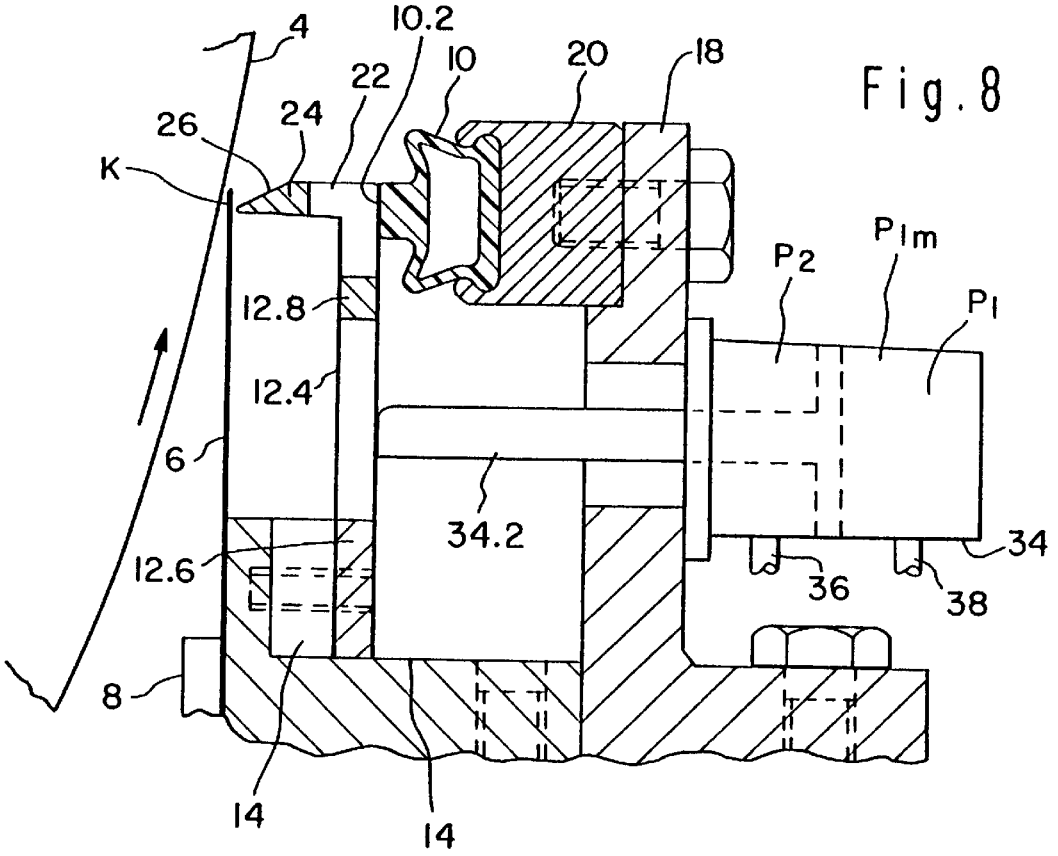
Figure 9:
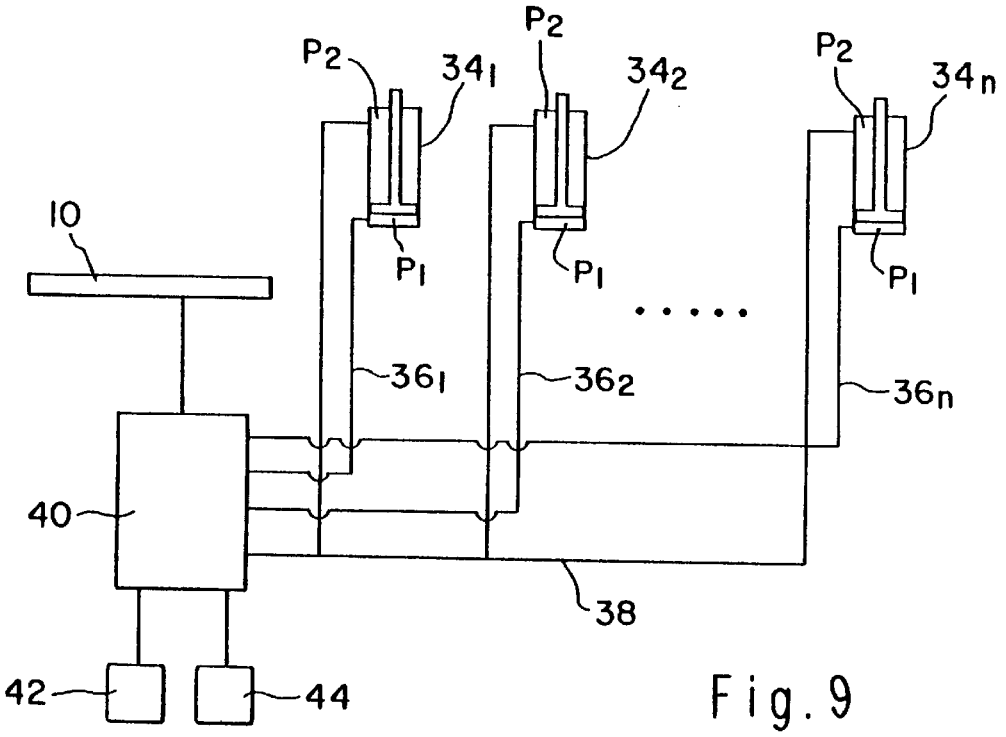

FIG. 8 shows a schematic cross-sectional representation of a seventh exemplary embodiment of the application unit according to the invention. The basic structure of this modification essentially equates with the embodiment in FIG. 7. But instead of the pressure pads 32, a plurality of double-action pneumatic cylinders 34 is used. The cylinder rods 34.2 of the respective pneumatic cylinders 34 can be connected to the parallelogram body 12 (e.g. via a suitable coupling link), i.e. it is possible to summon up both compressive and tractive forces, or not, which then merely allows the transfer of compressive forces. As can be identified in FIG. 9, which shows a schematic diagram of the arrangement of the plurality of double-action pneumatic cylinders $\mathbf{34}_1$ to $\mathbf{34}_n$ as part of a schematic horizontal projection, the one pressure side (for a pressure p1) of a respective one of the cylinders $\mathbf{34}_1$ to $\mathbf{34}_n$ is connected, in the present example, to a separate pressure line $\mathbf{36}_1$ to $\mathbf{36}_n$, while the other pressure side (for a pressure p2) of all the cylinders $\mathbf{34}_1$ to $\mathbf{34}_n$ is connected to a joint pressure line 38. The pressure lines $\mathbf{36}_1$ to $\mathbf{36}_n$ and 38 are connected to a control and regulating means 40 and are in turn connected via same to pressure sources 42, 44. The cylinders $\mathbf{34}_1$ to $\mathbf{34}_n$ are each individually responsive at their p1 pressure side and jointly responsive at their p2 pressure side. The following approaches are for example feasible in order to adjust a longitudinal profile and/or cross section.

Approach I:

Adjustment of the longitudinal profile by the pressure hose 10; adjustment of the cross section by applying pressure to the cylinders $\mathbf{34}_1$–$\mathbf{34}_n$ at a pressure p1 which can be respectively equal or different for the various cylinders.

Approach II:

longitudinal profile adjustment by means of the pressure hose 10; cross sectional adjustment by applying pressure to all the cylinders $\mathbf{34}_1$–$\mathbf{34}_n$ at a predetermined average pressure p1m and by positive or negative deviation from this pressure p1m at one or more of the cylinders $\mathbf{34}_1$–$\mathbf{34}_n$.

Approach III:

Pressure hose 10 deactivated; longitudinal profile adjustment by specifying the pressure p1 at all the cylinders $\mathbf{34}_1$–$\mathbf{34}_n$ and cross-sectional adjustment by increasing or decreasing the pressure p1 at one or more of the cylinders $\mathbf{34}_1$–$\mathbf{34}_n$.

Approach IV:

Pressure hose 10 deactivated; specifying a pressure p1 and a pressure p2 at all the cylinders $\mathbf{34}_1$–$\mathbf{34}_n$; longitudinal profile adjustment by jointly moving forwards and backwards all the cylinders $34_1$–$34_n$ by means of a uniform alteration of the pressure p1 and/or p2; cross-sectional adjustment by altering the pressure p1 and/or p2 at one or more of the cylinders $34_1$–$34_n$.

Approach V:

As a special instance of approach IV: longitudinal profile adjustment only by moving all the cylinders $34_1$–$34_n$ backwards by means of a uniform alteration of the pressure p2 (for this purpose, the p2 pressure side of all the cylinders is preferably connected to a joint pressure line) and cross-sectional adjustment by altering the pressure p1 at one or more of the cylinders $34_1$–$34_n$.

It is evident that the double-action cylinders 34 or $34_1$ to $34_n$ make various approaches possible for adjustment of the longitudinal profile and/or cross section, whereby the aforementioned approaches I–IV should merely be understood as examples. It is equally feasible to implement other approaches, e.g. by likewise activating the pressure hose 10 in approach IV above, etc. The double-action cylinders 34 also allow all the cylinders to return to a standby position or, in the case of a depressurized system, enable a specific cross-sectional pre-adjustment to be retained.

The application unit according to the invention comprises control and/or regulating means for the controlled adjustment of the pressing forces of the pressing means and/or (as already explained in conjunction with FIG. 9) the profiling means for longitudinal and/or transverse profiling. For the sake of clarity, this control and/or regulating means is not represented in FIGS. 1–8.

Figure 10:
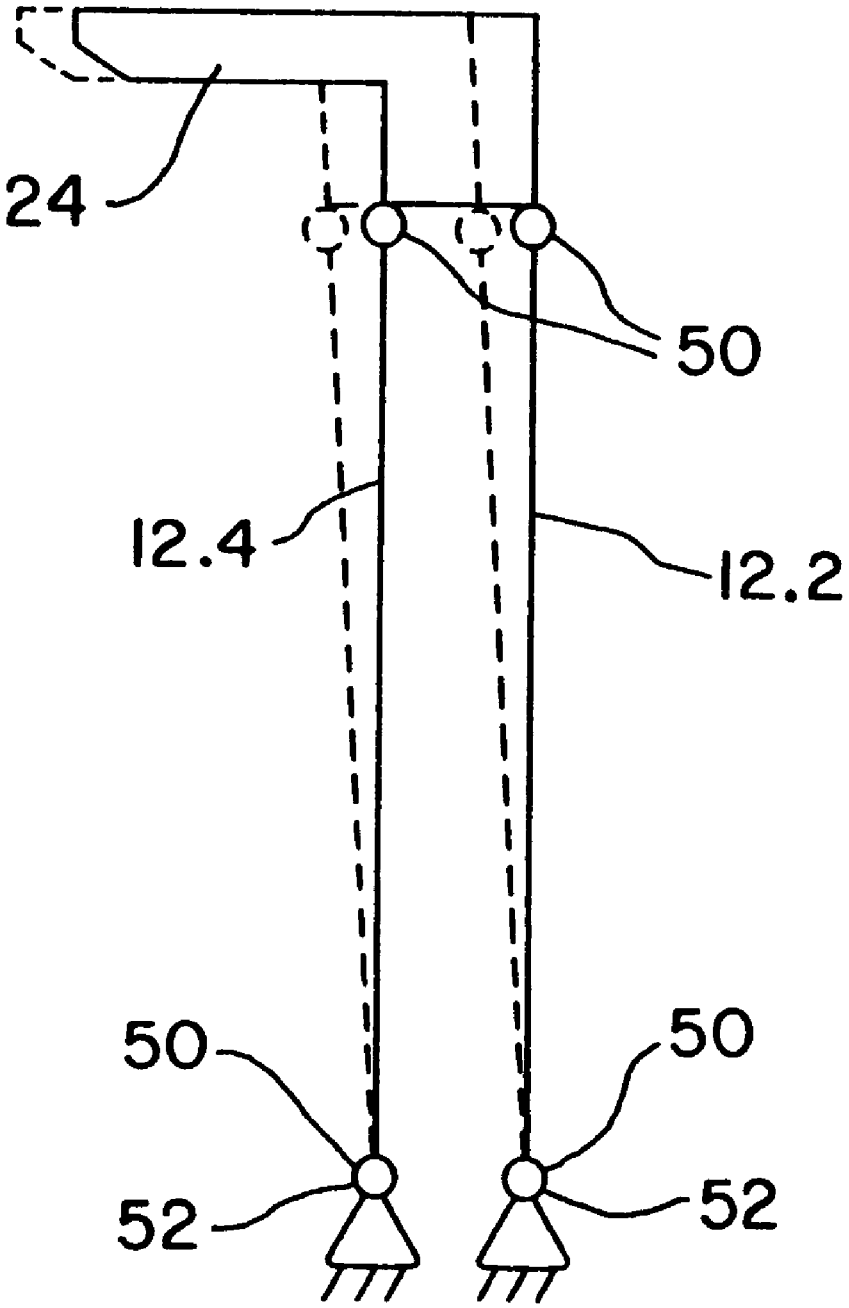

The invention is not restricted to the above embodiments which merely represent general exemplary views. On the contrary, the application unit according to the invention may—as part of the extent of protection—diverge considerably from these embodiments. In particular, the parallelogram body may, as shown in FIG. 10; comprise at least three individual members 12.2, 12.4 and 24 hingedly connected together with hinges 50. Two individual members 12.2 and 12.4 have an equal length, are spaced apart from one another in parallel and are hingedly secured at their respectively lower end to one of two bearings 52 disposed at a predetermined distance from one another. The third individual member of which hingedly connects the first two individual member 24 together at their upper ends, and had a length—when measured between the upper hinge points—corresponding to the distance between the two bearings of the first two individual members. It is not absolutely necessary either for the parallelogram body to have the slender, elongated cross-sectional form depicted in FIGS. 1 to 7 when examined in cross section. On the contrary, the parallelogram body also assume more compact cross-sectional shapes. Instead of the aforementioned materials, any other suitable materials can also be used to produce the parallelogram body. Any suitable attachment device can in principle be used to secure the parallelogram body to the support beam or to a component assigned to the support beam. Furthermore, individual actuators other than the pressure pads to be pneumatically actuated can also be used for a profiling means to adjust a cross section of the applied fluid or pasty medium or for a pressing means performing the functions of such a profiling means. Such individual actuators may for example just as equally relate to mechanical, pneumatic, hydraulic, electrical, magnetic, electromagnetic, thermal, electrothermal actuators and the like as well as combinations thereof.

Reference numerals in the claims, specification and drawings merely serve to render the invention more comprehensible and are not intended to restrict the extent of protection.

We claim:

1. An application unit for one of directly and indirectly applying a coating medium onto a traveling fiber material web having a width, said application unit comprising:

a support beam having a longitudinal direction, said support beam extending in said longitudinal direction substantially across the width of the material web;

a counter-roll opposite said support beam and having a width;

a doctor element extending substantially across said width of said counter-roll, said doctor element having a blade-element end mated with said counter-roll;

holding means for detachably securing said doctor element to said support beam;

a pressing member disposed on said support beam and configured for pressing said doctor element against said counter-roll at a predetermined pressure at said blade-element end mated with said counter-roll, said pressing member having a Parallelogram body when viewed in cross section, said parallelogram body extending substantially parallel to said doctor element when said parallelogram body is unbiased, said parallelogram body comprising at least three individual members hingedly connected together, two of said individual members each having an equal length, an upper end and a lower end, each said lower end hingedly secured to a respective bearing, said bearings being separated by a predetermined distance, said two individual members being mutually spaced apart in parallel, a third individual member of said at least three individual members having two opposing upper hinge points, each said upper hinge point being hingedly connected to a respective said upper end of said two individual members, said third individual member having a length between said upper hinge points corresponding to said predetermined distance between said bearings; and pressing means for one of directly and indirectly applying a pressing force to said pressing member.

2. An application unit according to claim 1, wherein said parallelogram body comprises an elastic spring element having a restoring force and a neutral position, said pressing means being configured to one of directly and indirectly act, starting from said neutral position of said parallelogram body, when said pressing means is activated, said parallelogram body being configured to return to said neutral position as a result of said restoring force when said pressing means is deactivated.

3. An application unit for one of directly and indirectly applying a coating medium onto a traveling fiber material web having a width, said application unit comprising:

a support beam having a longitudinal direction, said support beam extending in said longitudinal direction substantially across the width of the material web;

a counter-roll opposite said support beam and having a width;

a doctor element extending substantially across said width of said counter-roll, said doctor element having a blade-element end mated with said counter-roll;

holding means for detachably securing said doctor element to said support beam;

a pressing member disposed on said support beam and configured for pressing said doctor element against said counter-roll at a predetermined pressure at said blade-element end mated with said counter-roll, said pressing member having a parallelogram body with a sandwich structure when viewed in cross section, said parallelogram body extending substantially parallel to said doctor element when said parallelogram body is unbiased, said parallelogram body being configured for directly contacting said doctor element when said parallelogram body is pressed upon, said parallelogram body having an end, a lower portion, an upper portion, and two spaced apart and substantially parallel plates and at least two flat pieces disposed between said plates, said flat pieces being vertically spaced apart and connected to said plates, a lower of said flat pieces being located in said lower portion of said parallelogram body and an upper of said flat pieces being located in said upper portion of said parallelogram body;

a plurality of mounts, said parallelogram body being supported at said end one of in and on at least one said mount; and pressing means for one of directly and indirectly applying a pressing force to said pressing member.

4. An application unit according to claim 3, wherein said flat pieces have a thickness and said plates have a thickness, said thickness of said flat pieces being substantially greater than said thickness of said plates.

5. An application unit according to claim 4, wherein said flat pieces are at least one of affixed, soldered, welded, riveted and screwed to said plates.

6. An application unit according to claim 3, wherein said flat pieces are at least one of affixed, soldered, welded, riveted and screwed to said plates.

7. An application unit according to claim 3, wherein said parallelogram body has a longitudinal extension, said upper flat piece having a segmental division across said longitudinal extension of said parallelogram body.

8. An application unit according to claim 7, wherein said segmental division of said upper flat piece includes at least one separating line attached within said upper flat piece, said at least one separating line being mutually laterally spaced apart and extending substantially vertically.

9. An application unit for one of directly and indirectly applying a coating medium onto a traveling fiber material web having a width, said application unit comprising:

a support beam having a longitudinal direction, said support beam extending in said longitudinal direction substantially across the width of the material web;

a counter-roll opposite said support beam and having a width;

a doctor element extending substantially across said width of said counter-roll, said doctor element having a blade-element end mated with said counter-roll;

holding means for detachably securing said doctor element to said support beam;

a pressing member disposed on said support beam and configured for pressing said doctor element against said counter-roll at a predetermined pressure at said blade-element end mated with said counter-roll, said pressing member having a parallelogram body when viewed in cross section, said parallelogram body extending substantially parallel to said doctor element when said parallelogram body is unbiased, said parallelogram body having an end and an upper edge connected to a support lug, said support lug being angled toward said doctor element and having a contact edge configured for contacting said doctor element in direct proximity to said blade-element end of said doctor element mated with said counter-roll, said support lug including a rear side facing away from said doctor element;

a plurality of mounts, said parallelogram body being supported at said end one of in and on at least one said mount; and pressing means for one of directly and indirectly applying a pressing force to said pressing member, said pressing means including an outside surface;

wherein said support lug is configured for transferring a plurality of pressing forces originating from said pressing means at least one of directly and indirectly to said doctor element, said rear side of said support lug engaging said pressing means, said rear side of said support lug facing away from said doctor element comprising an adapter having a substantially C-shaped cross section with an inside surface securely conforming to said outside surface of said pressing means.

10. An application unit for one of directly and indirectly applying a coating medium onto a traveling fiber material web having a width, said application unit comprising:

a support beam having a longitudinal direction, said support beam extending in said longitudinal direction substantially across the width of the material web, a counter-roll opposite said support beam and having a width;

a doctor element extending substantially across said width of said counter-roll, said doctor element having a blade-element end mated with said counter-roll;

holding means for detachably securing said doctor element to said support beam;

a pressing member disposed on said support beam and configured for pressing said doctor element against said counter-roll at a predetermined pressure at said blade-element end mated with said counter-roll, said pressing member having a parallelogram body with a sandwich-like structure when viewed in cross section, said parallelogram body extending substantially parallel to said doctor element when said parallelogram body is unbiased, said parallelogram body being configured for directly contacting said doctor element when said parallelogram body is pressed upon, said parallelogram body including segmental divisions and a support lug, said support lug having segmental divisions, said parallelogram body having a pair of spaced apart and substantially parallel plates;

a plurality of heating elements, each said heating element being associated with at least one of said segmental divisions of said parallelogram body and said segmental divisions of said support lug of said parallelogram body, said heating elements being configured to selectively heat one of said plates of said parallelogram body to thereby change a length of said one plate and adjust said cross section of the coating medium;

a plurality of mounts, said parallelogram body being supported at said end one of in and on at least one said mount; and pressing means for one of directly and indirectly applying a pressing force to said pressing member.

* * * * *

UNITED STATES PATENT AND TRADEMARK OFFICE

CERTIFICATE OF CORRECTION

PATENT NO. : 5,932,010

DATED : August 3, 1999

INVENTOR(S) : Zygmunt Madrzak, et al.

It is certified that error appears in the above-identified patent and that said Letters Patent is hereby corrected as shown below:

COLUMN 17

Line 42, after "member", insert --24--; and line 43, delete "had" and substitute --has-- therefor.

Signed and Sealed this

Third Day of April, 2001

Nicholas P. Godici

*Attest:*

NICHOLAS P. GODICI

*Attesting Officer*

*Acting Director of the United States Patent and Trademark Office*